US008535603B2

(12) United States Patent
Cooper

(10) Patent No.: US 8,535,603 B2
(45) Date of Patent: Sep. 17, 2013

(54) ROTARY DEGASSER AND ROTOR THEREFOR

(76) Inventor: Paul V. Cooper, Chesterland, OH (US)

( * ) Notice: Subject to any disclaimer, the term of this patent is extended or adjusted under 35 U.S.C. 154(b) by 27 days.

(21) Appl. No.: 12/853,255

(22) Filed: Aug. 9, 2010

(65) Prior Publication Data

US 2011/0140320 A1 Jun. 16, 2011

Related U.S. Application Data

(60) Provisional application No. 61/232,384, filed on Aug. 7, 2009.

(51) Int. Cl.
*C22B 9/05* (2006.01)
*C21C 7/00* (2006.01)

(52) U.S. Cl.
USPC ..... 266/235; 222/594

(58) Field of Classification Search
USPC ..... 266/235; 222/594
See application file for complete search history.

(56) References Cited

U.S. PATENT DOCUMENTS

| | | | |
|---|---|---|---|
| 35,604 | A | 6/1862 | Guild |
| 116,797 | A | 7/1871 | Barnhart |
| 209,219 | A | 10/1878 | Bookwalter |
| 251,104 | A | 12/1881 | Finch |
| 364,804 | A | 6/1887 | Cole |
| 390,319 | A | 10/1888 | Thomson |
| 495,760 | A | 4/1893 | Seitz |
| 506,572 | A | 10/1893 | Wagener |
| 585,188 | A | 6/1897 | Davis |
| 757,932 | A | 4/1904 | Jones |
| 882,477 | A | 3/1908 | Neumann |
| 882,478 | A | 3/1908 | Neumann |
| 890,319 | A | 6/1908 | Wells |
| 898,499 | A | 9/1908 | O'Donnell |

(Continued)

FOREIGN PATENT DOCUMENTS

| | | |
|---|---|---|
| CA | 683469 | 3/1964 |
| CA | 2115929 | 8/1992 |

(Continued)

OTHER PUBLICATIONS

"Response to Final Office Action and Request for Continued Examination for U.S. Appl. No. 09/275,627," Including Declarations of Haynes and Johnson, Apr. 16, 2001.

(Continued)

*Primary Examiner* — Scott Kastler
(74) *Attorney, Agent, or Firm* — Snell & Wilmer L.L.P.

(57) ABSTRACT

A device for dispersing gas into molten metal includes an impeller, a drive shaft having a gas-transfer passage therein, and a first end and a second end, and a drive source. The second end of the drive shaft is connected to the impeller and the first end is connected to the drive source. The impeller includes a first portion and a second portion with a plurality of cavities. The first portion covers the second portion to help prevent gas from escaping to the surface without entering the cavities and being mixed with molten metal as the impeller rotates. When gas is transferred through the gas-transfer passage, it exits through the gas-release opening(s) in the bottom of the impeller. At least some of the gas enters the cavities where it is mixed with the molten metal being displaced by the impeller. Also disclosed are impellers that can be used to practice the invention.

19 Claims, 6 Drawing Sheets

(56) References Cited

U.S. PATENT DOCUMENTS

| | | | |
|---|---|---|---|
| 909,774 | A | 1/1909 | Flora |
| 919,194 | A | 4/1909 | Livingston |
| 1,037,659 | A | 9/1912 | Rembert |
| 1,100,475 | A | 6/1914 | Franckaerts |
| 1,196,758 | A | 9/1916 | Blair |
| 1,304,068 | A | 5/1919 | Krogh |
| 1,331,997 | A | 2/1920 | Neal |
| 1,377,101 | A | 5/1921 | Sparling |
| 1,380,798 | A | 6/1921 | Hansen et al. |
| 1,439,365 | A | 12/1922 | Hazell |
| 1,454,967 | A | 5/1923 | Gill |
| 1,470,607 | A | 10/1923 | Hazell |
| 1,513,875 | A | 11/1924 | Wilke |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,697,202 | A | 1/1929 | Nagle |
| 1,717,969 | A | 6/1929 | Goodner |
| 1,718,396 | A | 6/1929 | Wheeler |
| 1,896,201 | A | 2/1933 | Sterner-Rainer |
| 1,988,875 | A | 1/1935 | Saborio |
| 2,013,455 | A | 9/1935 | Baxter |
| 2,038,221 | A | 4/1936 | Kagi |
| 2,090,162 | A | 8/1937 | Tighe |
| 2,091,677 | A | 8/1937 | Fredericks |
| 2,138,814 | A | 12/1938 | Bressler |
| 2,173,377 | A | 9/1939 | Schultz, Jr. et al. |
| 2,264,740 | A | 12/1941 | Brown |
| 2,280,979 | A | 4/1942 | Rocke |
| 2,290,961 | A | 7/1942 | Heuer |
| 2,300,688 | A | 11/1942 | Nagle |
| 2,304,849 | A | 12/1942 | Ruthman |
| 2,368,962 | A | 2/1945 | Blom |
| 2,383,424 | A | 8/1945 | Stepanoff |
| 2,423,655 | A | 7/1947 | Mars et al. |
| 2,488,447 | A | 11/1949 | Tangen et al. |
| 2,493,467 | A | 1/1950 | Sunnen |
| 2,515,097 | A | 7/1950 | Schryber |
| 2,515,478 | A | 7/1950 | Tooley et al. |
| 2,528,208 | A | 10/1950 | Bonsack et al. |
| 2,528,210 | A | 10/1950 | Stewart |
| 2,543,633 | A | 2/1951 | Lamphere |
| 2,566,892 | A | 9/1951 | Jacobs |
| 2,625,720 | A | 1/1953 | Ross |
| 2,626,086 | A | 1/1953 | Forrest |
| 2,676,279 | A | 4/1954 | Wilson |
| 2,677,609 | A | 5/1954 | Moore et al. |
| 2,698,583 | A | 1/1955 | House et al. |
| 2,714,354 | A | 8/1955 | Farrand |
| 2,762,095 | A | 9/1956 | Pemetzrieder |
| 2,768,587 | A | 10/1956 | Corneil |
| 2,775,348 | A | 12/1956 | Williams |
| 2,779,574 | A | 1/1957 | Schneider |
| 2,787,873 | A | 4/1957 | Hadley |
| 2,808,782 | A | 10/1957 | Thompson et al. |
| 2,809,107 | A | 10/1957 | Russell |
| 2,821,472 | A | 1/1958 | Peterson et al. |
| 2,824,520 | A | 2/1958 | Bartels |
| 2,832,292 | A | 4/1958 | Edwards |
| 2,853,019 | A | 9/1958 | Thorton |
| 2,865,618 | A | 12/1958 | Abell |
| 2,901,677 | A | 8/1959 | Chessman et al. |
| 2,906,632 | A | 9/1959 | Nickerson |
| 2,918,876 | A | 12/1959 | Howe |
| 2,948,524 | A | 8/1960 | Sweeney et al. |
| 2,958,293 | A | 11/1960 | Pray, Jr. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,015,190 | A | 1/1962 | Arbeit |
| 3,039,864 | A | 6/1962 | Hess |
| 3,044,408 | A | 7/1962 | Mellott |
| 3,048,384 | A | 8/1962 | Sweeney et al. |
| 3,070,393 | A | 12/1962 | Silverberg et al. |
| 3,092,030 | A | 6/1963 | Wunder |
| 3,099,870 | A | 8/1963 | Seeler |
| 3,130,678 | A | 4/1964 | Chenault |
| 3,130,679 | A | 4/1964 | Sence |
| 3,171,357 | A | 3/1965 | Egger |
| 3,172,850 | A | 3/1965 | Englesberg et al. |
| 3,203,182 | A | 8/1965 | Pohl |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,258,283 | A | 6/1966 | Winberg et al. |
| 3,272,619 | A | 9/1966 | Sweeney et al. |
| 3,289,743 | A | 12/1966 | Louda |
| 3,291,473 | A | 12/1966 | Sweeney et al. |
| 3,374,943 | A | 3/1968 | Cervenka |
| 3,400,923 | A | 9/1968 | Howie et al. |
| 3,417,929 | A | 12/1968 | Secrest et al. |
| 3,432,336 | A | 3/1969 | Langrod |
| 3,459,133 | A | 8/1969 | Scheffler |
| 3,459,346 | A | 8/1969 | Tinnes |
| 3,477,383 | A | 11/1969 | Rawson et al. |
| 3,487,805 | A | 1/1970 | Satterthwaite |
| 1,185,314 | A | 3/1970 | London |
| 3,512,762 | A | 5/1970 | Umbricht |
| 3,512,788 | A | 5/1970 | Kilbane |
| 3,737,305 | A | 12/1970 | Blayden et al. |
| 3,561,885 | A | 2/1971 | Lake |
| 3,575,525 | A | 4/1971 | Fox et al. |
| 3,618,917 | A | 11/1971 | Fredrikson |
| 3,620,716 | A | 11/1971 | Hess |
| 3,650,730 | A | 3/1972 | Derham et al. |
| 3,689,048 | A | 9/1972 | Foulard et al. |
| 3,715,112 | A | 2/1973 | Carbonnel |
| 3,732,032 | A | 5/1973 | Daneel |
| 3,737,304 | A | 6/1973 | Blayden |
| 3,743,263 | A | 7/1973 | Szekely |
| 3,743,500 | A | 7/1973 | Foulard et al. |
| 3,753,690 | A | 8/1973 | Emley et al. |
| 3,759,628 | A | 9/1973 | Kempf |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,787,143 | A | 1/1974 | Carbonnel et al. |
| 3,799,522 | A | 3/1974 | Brant et al. |
| 3,799,523 | A | 3/1974 | Seki |
| 3,807,708 | A | 4/1974 | Jones |
| 3,814,400 | A | 6/1974 | Seki |
| 3,824,028 | A | 7/1974 | Zenkner et al. |
| 3,824,042 | A | 7/1974 | Barnes et al. |
| 3,836,280 | A | 9/1974 | Koch |
| 3,839,019 | A | 10/1974 | Bruno et al. |
| 3,844,972 | A | 10/1974 | Tully, Jr. et al. |
| 3,871,872 | A | 3/1975 | Downing et al. |
| 3,873,073 | A | 3/1975 | Baum et al. |
| 3,873,305 | A | 3/1975 | Claxton et al. |
| 3,881,039 | A | 4/1975 | Baldieri et al. |
| 3,886,992 | A | 6/1975 | Maas et al. |
| 3,915,594 | A | 10/1975 | Nesseth |
| 3,915,694 | A | 10/1975 | Ando |
| 3,941,588 | A | 3/1976 | Dremann |
| 3,941,589 | A | 3/1976 | Norman et al. |
| 3,954,134 | A | 5/1976 | Maas et al. |
| 3,958,979 | A | 5/1976 | Valdo |
| 3,958,981 | A | 5/1976 | Forberg et al. |
| 3,961,778 | A | 6/1976 | Carbonnel et al. |
| 3,966,456 | A | 6/1976 | Ellenbaum et al. |
| 3,967,286 | A | 6/1976 | Andersson et al. |
| 3,972,709 | A | 8/1976 | Chin et al. |
| 3,984,234 | A | 10/1976 | Claxton et al. |
| 3,985,000 | A | 10/1976 | Hartz |
| 3,997,336 | A | 12/1976 | van Linden et al. |
| 4,003,560 | A | 1/1977 | Carbonnel |
| 4,008,884 | A | 2/1977 | Fitzpatrick et al. |
| 4,018,598 | A | 4/1977 | Markus |
| 4,052,199 | A | 10/1977 | Mangalick |

4,055,390 A 10/1977 Young
4,063,849 A 12/1977 Modianos
4,068,965 A 1/1978 Lichti
4,091,970 A 5/1978 Kimiyama et al.
4,119,141 A 10/1978 Thut et al.
4,126,360 A 11/1978 Miller et al.
4,128,415 A 12/1978 van Linden et al.
4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A 9/1981 van Linden et al.
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,537,624 A 8/1985 Tenhover et al.
4,537,625 A 8/1985 Tenhover et al.
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,834,573 A 5/1989 Asano et al.
4,842,227 A 6/1989 Harrington et al.
4,844,425 A 7/1989 Piras et al.
4,851,296 A 7/1989 Tenhover et al.
4,859,413 A 8/1989 Harris et al.
4,867,638 A 9/1989 Handtmann et al.
4,884,786 A 12/1989 Gillespie
4,898,367 A 2/1990 Cooper
4,908,060 A 3/1990 Duenkelmann
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,973,433 A 11/1990 Gilbert et al.
4,986,736 A 1/1991 Kajiwara
4,989,736 A 2/1991 Andersson et al.
5,015,518 A 5/1991 Sasaki et al.
5,025,198 A 6/1991 Mordue et al.
5,028,211 A 7/1991 Mordue et al.
5,029,821 A 7/1991 Bar-on et al.
5,078,572 A 1/1992 Amra et al.
5,080,715 A 1/1992 Provencher et al.
5,088,893 A 2/1992 Gilbert et al.
5,092,821 A 3/1992 Gilbert et al.
5,098,134 A 3/1992 Monckton
5,114,312 A 5/1992 Stanislao
5,126,047 A 6/1992 Martin et al.
5,131,632 A 7/1992 Olson
5,143,357 A 9/1992 Gilbert et al.
5,145,322 A 9/1992 Senior, Jr. et al.
5,152,631 A 10/1992 Bauer
5,154,652 A 10/1992 Ecklesdafer
5,158,440 A 10/1992 Cooper et al.
5,162,858 A 11/1992 Shoji et al.
5,165,858 A 11/1992 Gilbert et al.
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A 7/1995 Aquino et al.
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,495,746 A 3/1996 Sigworth
5,505,143 A 4/1996 Nagel
5,505,435 A 4/1996 Laszlo
5,509,791 A 4/1996 Turner
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A 1/1997 Thut
5,613,245 A 3/1997 Robert
5,616,167 A 4/1997 Eckert
5,622,481 A 4/1997 Thut
5,629,464 A 5/1997 Bach et al.

| | | | |
|---|---|---|---|
| 5,634,770 | A | 6/1997 | Gilbert et al. |
| 5,640,706 | A | 6/1997 | Nagel et al. |
| 5,640,707 | A | 6/1997 | Nagel et al. |
| 5,640,709 | A | 6/1997 | Nagel et al. |
| 5,655,849 | A | 8/1997 | McEwen et al. |
| 5,660,614 | A | 8/1997 | Waite et al. |
| 5,662,725 | A | 9/1997 | Cooper |
| 5,676,520 | A | 10/1997 | Thut |
| 5,678,244 | A | 10/1997 | Shaw et al. |
| 5,678,807 | A | 10/1997 | Cooper |
| 5,679,132 | A | 10/1997 | Rauenzahn et al. |
| 5,685,701 | A | 11/1997 | Chandler et al. |
| 5,690,888 | A | 11/1997 | Robert |
| 5,695,732 | A | 12/1997 | Sparks et al. |
| 5,716,195 | A | 2/1998 | Thut |
| 5,717,149 | A | 2/1998 | Nagel et al. |
| 5,718,416 | A | 2/1998 | Flisakowski et al. |
| 5,735,668 | A | 4/1998 | Klein |
| 5,735,935 | A | 4/1998 | Areaux |
| 5,741,422 | A | 4/1998 | Eichenmiller et al. |
| 5,744,117 | A | 4/1998 | Wilikinson et al. |
| 5,745,861 | A | 4/1998 | Bell et al. |
| 5,772,324 | A | 6/1998 | Falk |
| 5,776,420 | A | 7/1998 | Nagel |
| 5,785,494 | A | 7/1998 | Vild et al. |
| 5,842,832 | A | 12/1998 | Thut |
| 5,858,059 | A | 1/1999 | Abramovich et al. |
| 5,863,314 | A | 1/1999 | Morando |
| 5,866,095 | A | 2/1999 | McGeever et al. |
| 5,875,385 | A | 2/1999 | Stephenson et al. |
| 5,935,528 | A | 8/1999 | Stephenson et al. |
| 5,944,496 | A | 8/1999 | Cooper |
| 5,947,705 | A | 9/1999 | Mordue et al. |
| 5,951,243 | A | 9/1999 | Cooper |
| 5,961,285 | A | 10/1999 | Meneice et al. |
| 5,963,580 | A | 10/1999 | Eckert |
| 5,992,230 | A | 11/1999 | Scarpa et al. |
| 5,993,726 | A | 11/1999 | Huang |
| 5,993,728 | A | 11/1999 | Vild |
| 6,019,576 | A | 2/2000 | Thut |
| 6,027,685 | A | 2/2000 | Cooper |
| 6,036,745 | A | 3/2000 | Gilbert et al. |
| 6,074,455 | A | 6/2000 | van Linden et al. |
| 6,082,965 | A | 7/2000 | Morando |
| 6,093,000 | A | 7/2000 | Cooper |
| 6,096,109 | A | 8/2000 | Nagel et al. |
| 6,113,154 | A | 9/2000 | Thut |
| 6,123,523 | A | 9/2000 | Cooper |
| 6,152,691 | A | 11/2000 | Thut |
| 6,168,753 | B1 | 1/2001 | Morando |
| 6,187,096 | B1 | 2/2001 | Thut |
| 6,199,836 | B1 | 3/2001 | Rexford et al. |
| 6,217,823 | B1 | 4/2001 | Vild et al. |
| 6,231,639 | B1 | 5/2001 | Eichenmiller |
| 6,250,881 | B1 | 6/2001 | Mordue et al. |
| 6,254,340 | B1 | 7/2001 | Vild et al. |
| 6,270,717 | B1 | 8/2001 | Tremblay et al. |
| 6,280,157 | B1 | 8/2001 | Cooper |
| 6,293,759 | B1 | 9/2001 | Thut |
| 6,303,074 | B1 | 10/2001 | Cooper |
| 6,345,964 | B1 | 2/2002 | Cooper |
| 6,354,796 | B1 | 3/2002 | Morando |
| 6,358,467 | B1 | 3/2002 | Mordue |
| 6,371,723 | B1 | 4/2002 | Grant et al. |
| 6,398,525 | B1 | 6/2002 | Cooper |
| 6,439,860 | B1 | 8/2002 | Greer |
| 6,451,247 | B1 | 9/2002 | Mordue et al. |
| 6,457,940 | B1 | 10/2002 | Lehman |
| 6,457,950 | B1 | 10/2002 | Cooper et al. |
| 6,464,458 | B2 | 10/2002 | Vild et al. |
| 6,497,559 | B1 | 12/2002 | Grant |
| 6,500,228 | B1 | 12/2002 | Klingensmith |
| 6,503,292 | B2 | 1/2003 | Klingensmith et al. |
| 6,524,066 | B2 | 2/2003 | Thut |
| 6,533,535 | B2 | 3/2003 | Thut |
| 6,551,060 | B2 | 4/2003 | Mordue et al. |
| 6,562,286 | B1 | 5/2003 | Lehman |
| 6,679,936 | B2 | 1/2004 | Quackenbush |
| 6,689,310 | B1 * | 2/2004 | Cooper ..... 266/235 |
| 6,709,234 | B2 | 3/2004 | Gilbert et al. |
| 6,723,276 | B1 | 4/2004 | Cooper |
| 6,805,834 | B2 | 10/2004 | Thut |
| 6,843,640 | B2 | 1/2005 | Mordue et al. |
| 6,848,497 | B2 | 2/2005 | Sale et al. |
| 6,869,271 | B2 | 3/2005 | Gilbert et al. |
| 6,869,564 | B2 | 3/2005 | Gilbert et al. |
| 6,881,030 | B2 | 4/2005 | Thut |
| 6,887,424 | B2 | 5/2005 | Ohno et al. |
| 6,887,425 | B2 | 5/2005 | Mordue et al. |
| 6,902,696 | B2 | 6/2005 | Klingensmith et al. |
| 7,083,758 | B2 | 8/2006 | Tremblay |
| 7,131,482 | B2 | 11/2006 | Vincent et al. |
| 7,157,043 | B2 | 1/2007 | Neff |
| 7,279,128 | B2 | 10/2007 | Kennedy et al. |
| 7,326,028 | B2 | 2/2008 | Morando |
| 7,402,276 | B2 | 7/2008 | Cooper |
| 7,470,392 | B2 | 12/2008 | Cooper |
| 7,476,357 | B2 | 1/2009 | Thut |
| 7,497,988 | B2 | 3/2009 | Thut |
| 7,507,367 | B2 | 3/2009 | Cooper |
| 7,906,068 | B2 | 3/2011 | Cooper |
| 8,110,141 | B2 | 2/2012 | Cooper |
| 2001/0000465 | A1 | 4/2001 | Thut |
| 2002/0146313 | A1 | 10/2002 | Thut |
| 2002/0185794 | A1 | 12/2002 | Vincent |
| 2003/0047850 | A1 | 3/2003 | Areaux |
| 2003/0201583 | A1 | 10/2003 | Killingsmith |
| 2004/0050525 | A1 | 3/2004 | Kennedy et al. |
| 2004/0076533 | A1 | 4/2004 | Cooper |
| 2004/0115079 | A1 | 6/2004 | Cooper |
| 2004/0262825 | A1 | 12/2004 | Cooper |
| 2005/0013713 | A1 | 1/2005 | Cooper |
| 2005/0013714 | A1 | 1/2005 | Cooper |
| 2005/0013715 | A1 | 1/2005 | Cooper |
| 2005/0053499 | A1 | 3/2005 | Cooper |
| 2005/0077730 | A1 | 4/2005 | Thut |
| 2005/0116398 | A1 | 6/2005 | Tremblay |
| 2006/0180963 | A1 | 8/2006 | Thut |
| 2007/0253807 | A1 | 11/2007 | Cooper |
| 2008/0213111 | A1 | 9/2008 | Cooper |
| 2008/0230966 | A1 | 9/2008 | Cooper |
| 2011/0140319 | A1 | 6/2011 | Cooper |

FOREIGN PATENT DOCUMENTS

| | | |
|---|---|---|
| CA | 2176475 | 5/1996 |
| CA | 2244251 | 12/1996 |
| CA | 2305865 | 2/2000 |
| CH | 392268 | 9/1965 |
| DE | 1800446 | 12/1969 |
| EP | 0168250 | 1/1986 |
| EP | 0665378 | 2/1995 |
| EP | 1019635 | 6/2006 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| MX | 227385 | 4/2005 |
| NO | 90756 | 1/1959 |
| SU | 416401 | 2/1974 |
| SU | 773312 | 10/1980 |
| WO | WO9808990 | 3/1998 |
| WO | WO9825031 | 6/1998 |
| WO | 0009889 | 2/2000 |
| WO | 0212147 | 2/2002 |

OTHER PUBLICATIONS

Document No. 504217: Excerpts from "Pyrotek Inc.'s Motion for Summary Judgment of Invalidity and Unenforceability of U.S. Patent No. 7,402,276," Oct. 2, 2009.

Document No. 505026: Excerpts from "MMEI's Response to Pyrotek's Motion for Summary Judgment of Invalidity or Enforceability of U.S. Patent No. 7,402,276," Oct. 9, 2009.

Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.
Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Nov. 15, 2007 in U.S. Appl. No. 10/773,101.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Office Action dated Sep. 22, 2011 in U.S. Appl. No. 11/766,617.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated May 22, 2009 in U.S. Appl. No. 12/369,362.
USPTO; Final Office Action dated Dec. 14, 2009 in U.S. Appl. No. 12/369,362.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Sep. 22, 2011 in U.S. Appl. No. 12/880,027.
USPTO; Office Action dated Aug. 25, 2011 in U.S. Appl. No. 13/047,747.
USPTO; Office Action dated Aug. 25, 2011 in U.S. Appl. No. 13/047,719.
USPTO; Office Action dated Aug. 27, 2001 in U.S. Appl. No. 90/005,910.
CIPO; Office Action dated Dec. 4, 2001 in Application No. 2,115,929.
CIPO; Office Action dated Apr. 22, 2002 in Application No. 2,115,929.
CIPO; Office Action dated Jun. 30, 2003 in Application No. 2,176,475.
CIPO; Office Action dated May 29, 2000 in Application No. 2,242,174.
CIPO; Office Action dated Feb. 22, 2006 in Application No. 2,244,251.
CIPO; Office Action dated Mar. 27, 2007 in Application No. 2,244,251.
CIPO; Office Action dated Sep. 18, 2002 in Application No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Office Action dated Nov. 28, 2011 in U.S. Appl. No. 12/120,190.
USPTO; Notice of Allowance dated Nov. 1, 2011 in U.S. Appl. No. 12/146,770.
USPTO; Office Action dated Nov. 4, 2011 in U.S. Appl. No. 12/264,416.
USPTO; Final Office Action dated Dec. 16, 2011 in U.S. Appl. No. 13/047,719.
USPTO; Final Office Action dated Dec. 13, 2011 in U.S. Appl. No. 12/395,430.
USPTO; Office Action dated Feb. 23, 1996 in U.S. Appl. No. 08/439,739.
USPTO; Office Action dated Aug. 15, 1996 in U.S. Appl. No. 08/439,739.

USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15, 1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 29, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Jun. 27, 2006 in U.S. Appl. No. 10/773,102.
USPTO; Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance Apr. 18, 2008 in U.S. Appl. No. 10/773,102.
USPTO; Office Action dated Jul. 24, 2006 in U.S. Appl. No. 10/773,105.
USPTO; Final Office Action dated Jul. 21, 2007 in U.S. Appl. No. 10/773,105.
USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.

USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Notice of Allowance dated Feb. 6, 2012 in U.S. Appl. No. 12/120,190.
USPTO; Final Office Action dated Feb. 3, 2012 in U.S. Appl. No. 12/120,200.
USPTO; Final Office Action dated Jun. 8, 2012 in U.S. Appl. No. 12/264,416.
USPTO; Advisory Action dated Feb. 22, 2012 in U.S. Appl. No. 12/395,430.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Office Action dated May 29, 2012 in U.S. Appl. No. 12/878,984.
USPTO; Final Office Action dated Feb. 16, 2012 in U.S. Appl. No. 12/880,027.
USPTO; Office Action dated Sep. 11, 2012 in U.S. Appl. No. 13/047,719.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Apr. 18, 2012 in U.S. Appl. No. 13/252,145.
USPTO; Final Office Action dated Sep. 17, 2012 in U.S. Appl. No. 13/252,145.
CIPO; Notice of Allowance dated Jul. 18, 2003 in Application No. 2,115,929.
CIPO; Notice of Allowance dated Sep. 15, 2004 in Application No. 2,176,475.
CIPO; Notice of Allowance dated Jan. 15, 2008 in Application No. 2,244,251.
CIPO; Notice of Allowance dated May 2, 2003 in Application No. 2,305,865.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Notice of Allowance dated Sep. 20, 2012 in U.S. Appl. No. 12/395,430.
USPTO; Notice of Allowance dated Oct. 2, 2012 in U.S. Appl. No. 12/853,253.
USPTO; Office Action dated Oct. 3, 2012 in U.S. Appl. No. 12/878,984.
USPTO; Notice of Allowance dated Nov. 21, 2012 in U.S. Appl. No. 12/853,268.
USPTO; Notice of Allowance dated Nov. 30, 2012 in U.S. Appl. No. 13/252,145.
USPTO; Office Action dated Nov. 28, 2012 in U.S. Appl. No. 12/264,416.
USPTO; Office Action dated Dec. 13, 2012 in U.S. Appl. No. 13/047,747.
USPTO; Office Action dated Dec. 14, 2012 in U.S. Appl. No. 12/880,027.
USPTO; Office Action dated Jan. 3, 2013 in U.S. Appl. No. 12/853,238.
USPTO; Notice of Allowance dated Jan. 17, 2013 in U.S. Appl. No. 12/120,200.
USPTO; Final Office Action dated Jan. 25, 2013 in U.S. Appl. No. 12/878,984.
USPTO; Notice of Allowance dated Jan. 31, 2013 in U.S. Appl. No. 12/853,201.
USPTO; Notice of Allowance dated Feb. 28, 2013 in U.S. Appl. No. 13/047,719.
USPTO; Notice of Allowance dated Mar. 28, 2013 in U.S. Appl. No. 12/878,984.
USPTO; Ex Parte Quale Office Action dated Apr. 3, 2012 in U.S. Appl. No. 12/264,416.
USPTO; Notice of Allowance dated Apr. 3, 2013 in U.S. Appl. No. 13/047,747.
USPTO; Office Action dated Apr. 12, 2013 in U.S. Appl. No. 13/106,853.

* cited by examiner

ROTARY DEGASSER AND ROTOR THEREFOR

BACKGROUND OF THE INVENTION

Field of the Invention

The invention relates to dispersing gas into molten metal. More particularly, the invention relates to a device, such as a rotary degasser, having an impeller that efficiently mixes gas into molten metal and efficiently displaces the molten metal/gas mixture. This application claims priority to U.S. Provisional Application No. 61/232,384 to Cooper filed on Aug. 7, 2009 and entitled "Rotary Degasser and Rotor Therefor."

Description of the Related Art

As used herein, the term "molten metal" means any metal in liquid form, such as aluminum, copper, iron, zinc and alloys thereof, which is amenable to gas purification or that otherwise has gas mixed with it. The term "gas" means any gas or combination of gases, including argon, nitrogen, chlorine, fluorine, freon, and helium, that are mixed with molten metal.

In the course of processing molten metals it is sometimes necessary to treat the molten metal with gas. For example, it is customary to introduce gases such as nitrogen and argon into molten aluminum and molten aluminum alloys in order to remove undesirable constituents such as hydrogen gas and non-metallic inclusions. Chlorine gas is introduced into molten aluminum and molten aluminum alloys to remove alkali metals, such as magnesium. The gases added to the molten metal chemically react with the undesired constituents to convert them to a form (such as a precipitate or dross) that separates or can be separated from the molten metal. In order to improve efficiency the gas should be dispersed (or mixed) throughout the molten metal as thoroughly as possible. The more thorough the mixing the greater the number of gas molecules contacting the undesirable constituents contained in the molten metal. Efficiency is related to, among other things, (1) the size and quantity of the gas bubbles, and (2) how thoroughly the bubbles are mixed with the molten metal throughout the vessel containing the molten metal.

It is known to introduce gases into molten metal by injection through stationary members such as lances or porous diffusers. Such techniques suffer from the drawback that there is often inadequate dispersion of the gas throughout the molten metal. It is also known to inject degassing flux through an opening into the molten metal, which again, results in the flux mixing with only the molten metal near where it is released. In order to improve the dispersion of the gas throughout the molten metal, it is known to stir the molten metal while simultaneously introducing gas, or to convey the molten metal past the source of gas injection. Some devices that stir the molten metal while simultaneously introducing gas are called rotary degassers. Examples of rotary degassers are shown in U.S. Pat. No. 4,898,367 entitled "Dispersing Gas into Molten Metal" and U.S. Pat. No. 5,678,807 entitled "Rotary Degassers," the disclosures of which are incorporated herein by reference.

Devices that convey molten metal past a gas source while simultaneously injecting gas into the molten metal include pumps having a gas-injection, or gas-release, device. Such a pump generates a molten metal stream through a confined space such as a pump discharge or a metal-transfer conduit connected to the discharge. Gas is then released into the molten metal stream while (1) the stream is in the confined space, or (2) as the stream leaves the confined space.

Many known devices do not efficiently disperse gas into the molten metal bath. Therefore, the impurities in the molten metal are not adequately removed and/or an inordinate amount of gas is used to remove the impurities. This inefficiency is a function of, among other things, (1) an inability to create small gas bubbles to mix with the molten metal, and (2) an inability to displace the gas bubbles and/or the molten metal/gas mixture throughout the vessel containing the molten metal. With conventional devices (other than the previously-described pumps), gas released into the bath tends to rise vertically through the bath to the surface, and the gas has little or no interaction with the molten metal in the vessel relatively distant from the gas-release device. The molten metal/gas mixture is not sufficiently displaced throughout the entire bath. Therefore, to the extent gas is mixed with the molten metal, it is generally mixed only with the molten metal immediately surrounding the device.

SUMMARY OF THE INVENTION

In accordance with the invention, an improved impeller for use with a rotary degasser is disclosed. The impeller (also referred to as a rotor) has a connector, a first (or top) portion, a second (or lower) portion, a top surface, a side surface, a bottom surface, a gas-release opening, and a plurality of cavities formed in the side surface of the second portion, and open to the lower surface. The impeller is driven by a drive source that rotates a drive shaft connected to the impeller. The first end of the drive shaft is connected to the drive source, which is typically a pneumatic motor but can be any suitable drive source, and the second end of the drive shaft is connected to the connector of the impeller.

The impeller is designed to displace molten metal, thereby efficiently circulating the molten metal within a vessel while simultaneously mixing the molten meal with gas. The impeller's top portion is preferably rectangular (and most preferably square) in plan view, has four sides, a top surface, a side surface, and a lower surface. The top portion may, however, be of any suitable size and shape to help prevent gas released from the gas release opening from escaping to the surface of the molten metal bath without mixing with the molten metal by the rotation of the second portion of the impeller.

The second portion of the impeller includes a plurality of cavities, wherein the cavities are open to the lower surface of the impeller. Preferably, there are eight cavities, equally, radially spaced about the circumference of the second portion, although any suitable number could be utilized. The connector is preferably located in the first portion and connects the impeller to the second end of the shaft. Most preferably the connector is a threaded bore extending into the impeller. The bore threadingly receives the second end of the shaft. The gas-release opening may be, and is preferably, the opening in the lower surface of the impeller formed by the bore that accepts the second end of the drive shaft. The second end of the shaft preferably terminates at or before the gas-release opening, and gas passing through the shaft can escape through the gas release opening at the bottom of the impeller, where it rises and at least some enters the cavities.

The drive source rotates the shaft and the impeller. A gas source is preferably connected to the first end of the shaft and releases gas into the passage. The gas travels through the passage and is released through one or more gas-release openings in the bottom surface of the impeller. At least part of the gas enters the cavities, where it is mixed with the molten metal as the impeller rotates, and the top portion helps prevent the gas from rising to the surface in order to facilitate better mixing. The molten metal/gas mixture is displaced radially by the impeller as it rotates.

BRIEF DESCRIPTION OF THE DRAWINGS

The accompanying drawings, which are incorporated in and constitute a part of this specification, illustrate preferred embodiments of the invention and together with the description, serve to explain principles of the invention.

DETAILED DESCRIPTION OF PREFERRED EMBODIMENTS

Figure 1:
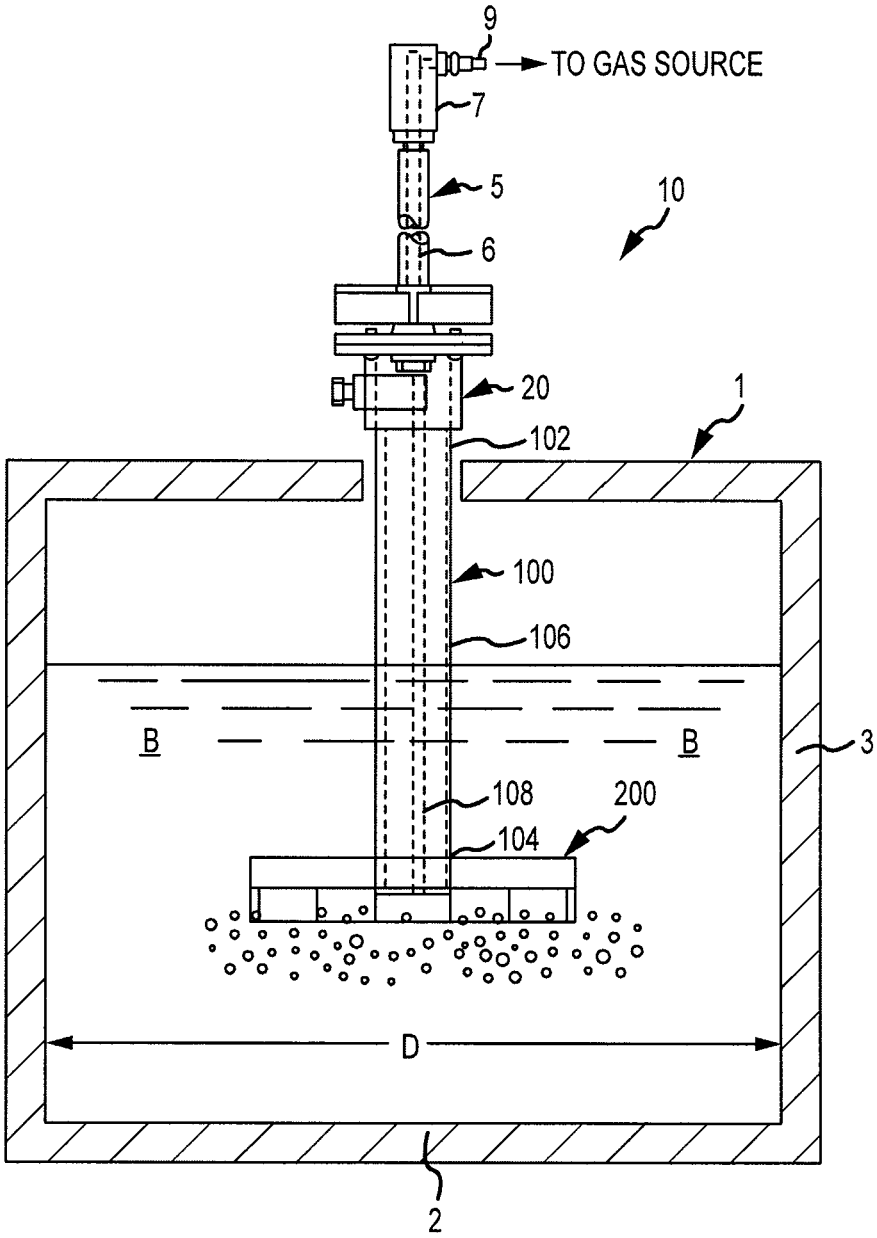
FIG. 1 is a side view of a gas-release device according to the invention positioned in a vessel containing a molten metal bath.

FIG. 1 shows an exemplary gas-release device 10 according to the invention. Device 10 is adapted to operate in a molten metal bath B contained within a vessel 1. Vessel 1 is provided with a lower wall 2 and side wall 3. Vessel 1 can be provided in a variety of configurations, such as rectangular or cylindrical. In this exemplary embodiment, vessel 1 includes a cylindrical side wall 3 and has an inner diameter D.

Device 10, which is preferably a rotary degasser, includes a shaft 100, an impeller 200 and a drive source (not shown). Device 10 preferably also includes a drive shaft 5 and a coupling 20. Shaft 100, impeller 200, and each of the impellers used in the practice of the invention, are preferably made of graphite impregnated with oxidation-resistant solution, although any material capable of being used in a molten metal bath B, such as ceramic, could be used. Oxidation and erosion treatments for graphite parts are practiced commercially, and graphite so treated can be obtained from sources known to those skilled in the art.

The drive source can be any apparatus capable of rotating shaft 100 and impeller 200 and is preferably a pneumatic motor or electric motor, the respective structures of which are known to those skilled in the art. The drive source can be connected to shaft 100 by any suitable means, but is preferably connected by drive shaft 5 and coupling 20. Drive shaft 5 is preferably comprised of steel, has an inner passage 6 for the transfer of gas, and preferably extends from the drive source to which it is connected by means of a rotary union 7. Drive shaft 5 is coupled to impeller shaft 100 by coupling 20. The preferred coupling 20 for use in the invention is described in U.S. Pat. No. 5,678,807, the disclosure of which is incorporated herein by reference.

Figure 2:
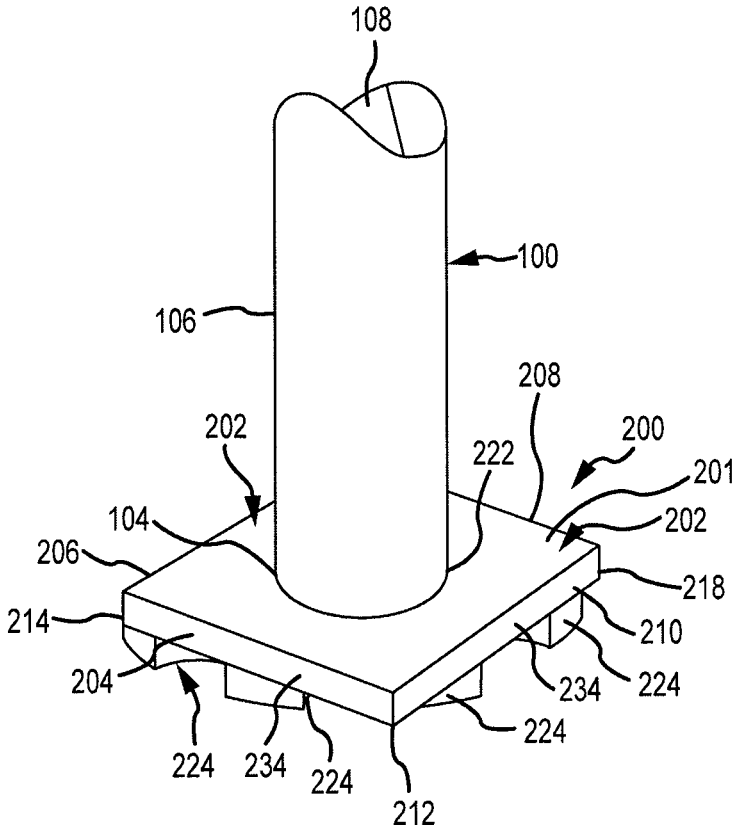
FIG. 2 is a partial perspective view of the device of FIG. 1 showing the degasser shaft and impeller.

As is illustrated in FIGS. 1 and 2, shaft 100 has a first end 102, a second end 104, a side 106 and an inner passage 108 for transferring gas. Shaft 100 may be a unitary structure or may be a plurality of pieces connected together. The purpose of shaft 100 is to connect to an impeller to (1) rotate the impeller, and (2) transfer gas. Any structure capable of performing these functions can be used.

First end 102 is connected to the drive source, preferably by shaft 5 and coupling 20, as previously mentioned. In this regard, first end 102 is preferably connected to coupling 20, which in turn is connected to motor drive shaft 5. Shaft 5 is connected to rotary union 7. A typical rotary union 7 is a rotary union of the type described in U.S. Pat. No. 6,123,523 to Cooper, the disclosure of which is incorporated herein by reference. Side 106 is preferably cylindrical and may be threaded, tapered, or both, at end 102. In the embodiment shown, end 102 (which is received in coupling 20) is smooth and is not tapered. Side 106 is preferably threaded at end 104 for connecting to impeller 200. Passage 108 is connected to a gas source (not shown), preferably by connecting the gas source to nozzle 9 of rotary union 7, and transferring gas through a passage in rotary union 7, through inner passage 6 in shaft 5 and into passage 108.

Figure 3A:
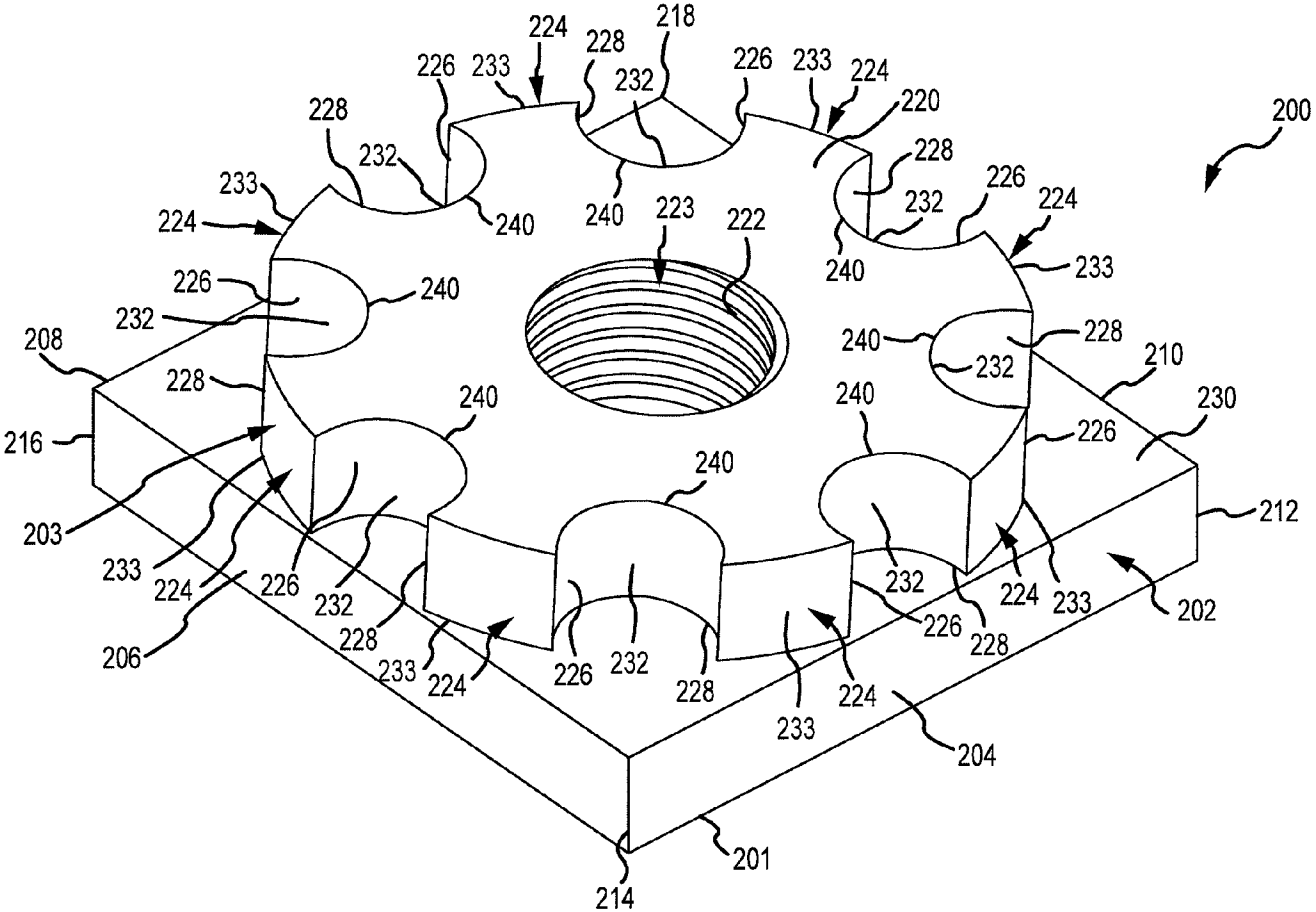
FIG. 3A is a perspective view of the underside of the impeller shown in FIGS. 1 and 2.

Turning now to FIG. 3A, an impeller 200 according to one embodiment of the invention is shown. Impeller 200 is designed to displace a relatively large quantity of molten metal in order to improve the efficiency of mixing the gas and molten metal within bath B. Therefore, impeller 200 can, at a slower speed (i.e., lower revolutions per minute (rpm)), mix the same amount of gas with molten metal as conventional devices operating at higher speeds. Impeller 200 can also operate at a higher speed, thereby mixing more gas and molten metal than conventional devices operating at the same speed.

By operating impeller 200 at a lower speed, less stress is transmitted to the moving components, which leads to longer component life, less maintenance and less maintenance downtime. Another advantage that may be realized by operating the impeller at slower speeds is the elimination of a vortex. Some conventional devices must be operated at high speeds to achieve a desired efficiency. This can create a vortex that draws air into the molten metal from the surface of bath B. The air can become trapped in the molten metal and lead to metal ingots and finished parts that have air pockets, which is undesirable.

FIG. 3A depicts the underside of impeller 200. Impeller 200 has a top surface 201 of top portion 202, a side surface 203, and a lower surface 220. Top portion 202 is preferably rectangular and most preferably square in plan view, with four corners 212, 214, 216, and 218, and sides 204, 206, 208, and 210, being preferably equal in length. Top portion 202 could also be triangular, circular, pentagonal, or otherwise polygonal in plan view. Though it may be any suitable dimension, top portion 202 extends from the center of the gas-release opening 223 beyond the length of the protrusion 224 from the center of the gas-release opening 223. Top portion 202 assists in the capture of gas, mixing of gas and molten metal, and dispersal of mixed molten metal.

Referring to FIG. 2, connector 222 is formed in top portion 202. Connector 222 is preferably a threaded bore that extends from top portion 202 to lower surface 220 and terminates in gas-release opening 223. Top portion 202 may comprise any other suitable structure for connecting the top portion 202 and the shaft 100.

In one embodiment, protrusions 224 are preferably equally spaced (e.g., preferably at 45 degree angles) around the center of the impeller 200. However, one or more of the protrusions 224 could be formed at varied angle increments from each other. In one embodiment, the center of the outward face of the protrusion 224 is approximately 22.5 degrees from a line formed from the extension of corner 218 to the center of the gas-release opening 223. Each protrusion 224 preferably has identical dimensions and configuration. The protrusions 224 need not, however, be identical in configuration or dimension, as long as a portion of the gas released through the gas-release opening 223 is capable of entering the spaces (or cavities) between protrusions 224, so it is mixed with the molten metal entering the space. Further, an impeller according to the invention could function with fewer than, or more than, eight protrusions 224 and fewer than, or more than, eight cavities. Additionally, the length of each protrusion 224 may be greater or smaller than shown.

An impeller 200 may have one or more protrusions 224 formed in top portion 202 of impeller 200, and the lower surface 220 of the impeller 200 may or may not also include one or more protrusions 224. Impeller 200 can be used conjunction with a device that directed molten metal downward towards the spaces (or cavities) between the protrusions 224 in top portion 202. Such a device could be an additional vane on impeller 200 above top portion 202, wherein the additional vane directs molten metal downward towards the one or more spaces (or cavities) between the protrusions 224. The spaces (or cavities) between the protrusions 224 in top portion 202 may have the same shape, number and relative locations with respect to the spaces (or cavities) between the protrusions 224 in lower surface 220.

Figure 3B:
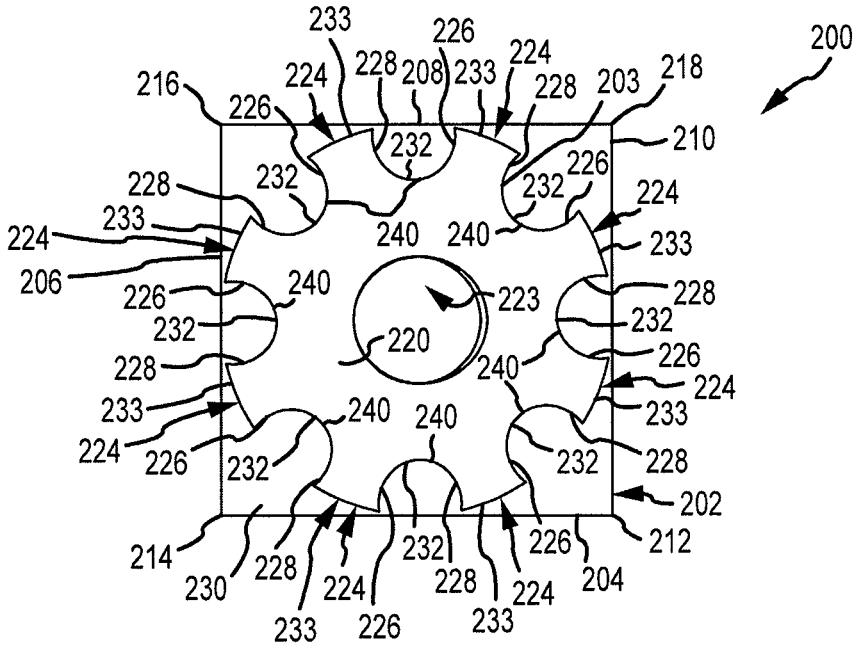
FIG. 3B is a top view of the impeller shown in FIGS. 1, 2, and 3A.
Figure 3C:
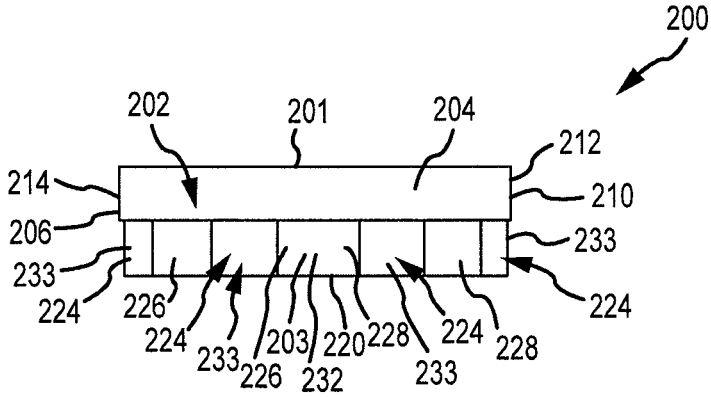
FIG. 3C is a side view of the impeller shown in FIGS. 1, 2, 3A, and 3B.

FIGS. 3B and 3C depict top and side views, respectively, of the impeller 200. The spaces (or cavities) between the protrusions 224 formed in the side surface 203 are open to lower surface 220. Protrusion 224 has two radiused sides 226 and 228. Though it may be any suitable shape, a convex radiused center 233 connects sides 226 and 228. This convex shape assists in the smooth rotation of the lower portion of impeller 200 through the molten metal. Additionally, though it may be any suitable shape, a concave radiused center 232 in each cavity connects sides 226, 228 of adjoining protrusions 224. This preferred, concave shape (or cavity) assists in the capture of gas exiting the gas-release opening 223. The space (or cavity) between the protrusions 224 is partially formed between adjoining sides 226, 228, connected by the concave radiused center 232 and underneath a top wall 230 (bottom surface of top portion 202). A lip 234 is formed between top wall 230 and the top surface 201 of top portion 202. Lip 234 may have an approximate width of 1 inch. Lower surface 220 has edges 240 between each of the spaces (or cavities) between the protrusions 224.

Second end 104 of shaft 100 is preferably connected to impeller 200 by threading end 104 into connector 222. If desired, shaft 100 could be connected to impeller 200 by techniques other than a threaded connection, such as by being cemented or pinned. A threaded connection is preferred due to its strength and ease of manufacture. The use of coarse threads (4 pitch, UNC) facilitates manufacture and assembly. The threads may be tapered (not shown).

Figure 4A:
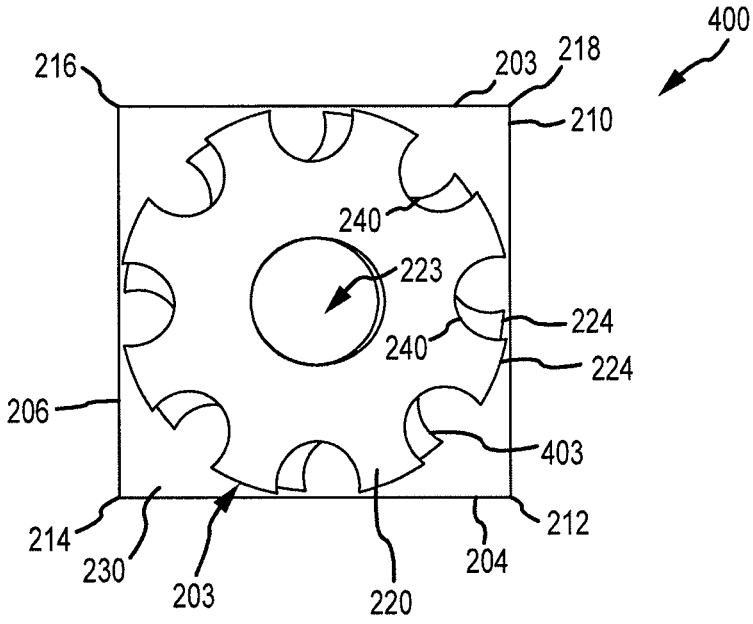
FIG. 4A is a top view of another impeller according to an embodiment of the invention.
Figure 4B:
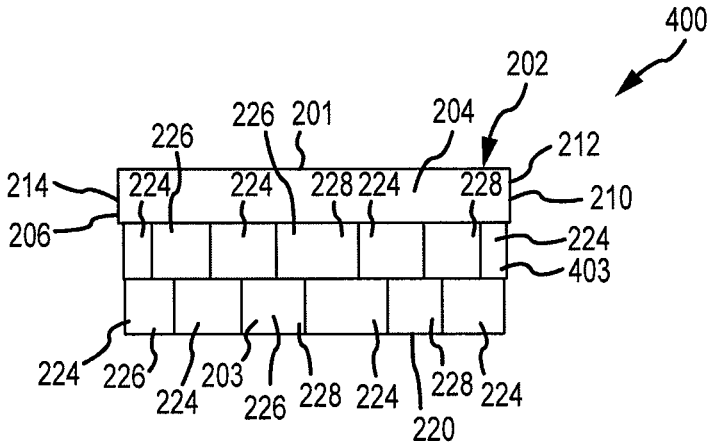
FIG. 4B is a side view of the impeller shown in FIG. 4A.

FIGS. 4A and 4B depict top and side views, respectively, of another embodiment of the present invention. In this embodiment, an upper impeller portion 403 of impeller 400 is located between an lower impeller portion 203 and top portion 202. This lower impeller portion 203 is coupled to, and may be offset from, the upper impeller portion 403. Additional impeller portions may be added and oriented as desired to further direct, mix, and distribute gas and molten metal. Lower impeller portion 203 and upper impeller portion 403 may be integral to each other, the top portion 202 and/or the device or they may be separate components.

Figure 5A:
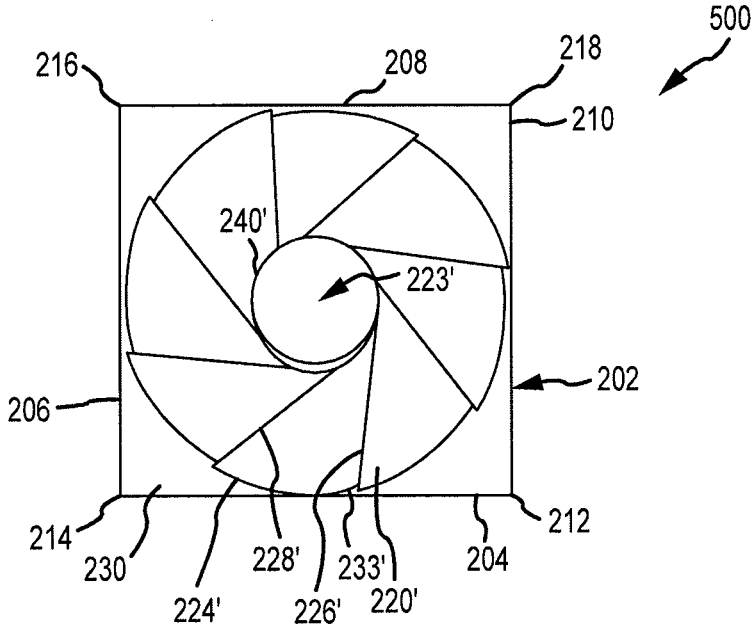
FIG. 5A is a top view of another impeller according to an embodiment of the invention.
Figure 5B:
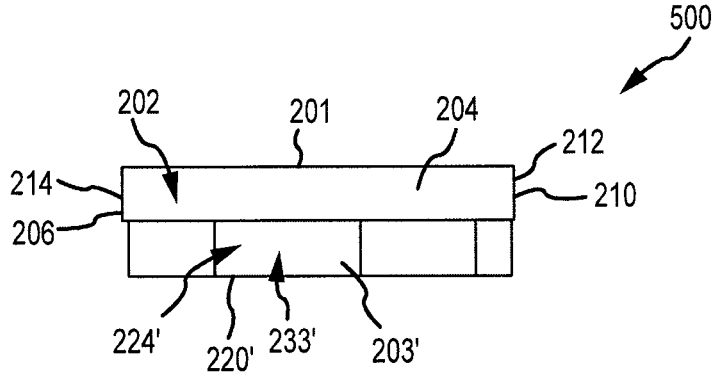
FIG. 5B is a side view of the impeller shown in FIG. 5A.

FIGS. 5A and 5B depict top and side views, respectively, of another embodiment of the present invention. In this embodiment, impeller 500 has a lower surface 220 with edges 240 adjacent to the gas-release opening 223. This orientation allows for efficient transfer of gas into the spaces (or cavities) between the protrusions 224. The cavities and protrusions 224 of impeller 500 are oriented to direct the flow of gas from the gas-release opening 223 into the cavities 223. In the embodiment depicted in FIGS. 5A and 5B, the protrusions 224 are sloped. The protrusions 224 can have any suitable slope to aid in the dispersal and mixing of gas with molten metal, including vertical (i.e., perpendicular with the top surface 201). In an embodiment with vertically sloped protrusions 224, the space (or cavity) between the protrusions 224 may comprise channels along surface 230 for the gas to travel within. These channels may extend from the lip of the gas-release opening 223 to the end of the protrusion 224. Impeller 500 may have fewer or more than eight protrusions 224 and more or fewer than eight cavities for directing the flow of gas.

As with the described embodiments of impellers 200 and 400, top portion 202 of impeller 500 is preferably rectangular and most preferably square in plan view, with four corners 212, 214, 216 and 218, and sides 204, 206, 208, and 210, being preferably equal in length. It also is possible that top portion 202 could be triangular, circular, pentagonal, or otherwise polygonal in plan view. Though top portion 202 may be any suitable dimension, top portion 202 extends from the center of the gas-release opening 223 beyond the length of the protrusion 224 from the center of the gas-release opening 223.

Any of the impellers described herein may be used with components or devices formed or placed above and/or below the impeller. Such device or devices could either direct molten metal upward from the bottom of the bath or downward from the top of the bath. Such device(s) may be attached to the shaft and/or attached to the impeller. For example, any of the impellers described herein may have an additional vane or projection beneath the lower surface to direct molten metal upward, or an additional vane or projection above the upper surface to direct molten metal downward. Unless specifically disclaimed, all such embodiments are intended to be covered by the claims.

Upon placing impeller 200 in molten metal bath B and releasing gas through passage 108, the gas will be released through gas-release opening 223 and flow outwardly along lower surface 220. Gas-release opening 223 is preferably located in the center of the bottom surface 220 of the impeller 200. Alternatively, there may one or more gas-release openings 223 in each of spaces (or cavities) between the protrusions 224, at location 232, in which case opening 223 would be preferably sealed. Further, end 104 could extend beyond lower surface 220 in which case the opening in end 104 would be the gas-release opening.

As shaft 100 and impeller 200 rotate, the gas bubbles rise and at least some of the gas enters spaces (or cavities) between the protrusions 224. The released bubbles are sheared into smaller bubbles as they move past a respective edge 240 of lower surface 220 before they enter the space (or cavity) between the protrusions 224. As impeller 200 turns, the gas in each of spaces (or cavities) between the protrusions 224 mixes with the molten metal entering the spaces between the protrusions 224. This mixture is pushed outward from impeller 200 at least partially by the top portion 202. The molten metal/gas mixture is thus efficiently displaced within vessel 1. When the molten metal is aluminum and the treating gas is nitrogen or argon, shaft 100 and impeller 200 preferably rotate within the range of 200-400 revolutions per minute.

The present invention allows high volumes of gas to be thoroughly mixed with molten metal at relatively low impeller speeds. Unlike some conventional devices that do not have spaces (or cavities) between the protrusions 224, the gas cannot simply rise past the side of the impeller. Thus, impeller 200 can operate at slower speeds than conventional impellers, yet provide the same or better results. Some impellers operate at high speeds in an effort to mix the gas quickly before it rises past the side of the impeller. Device 10 can pump a gas/molten metal mixture at nominal displacement rates of 1 to 2 cubic feet per minute (cfm), and flow rates as high as 4 to 5 cfm can be attained.

Having thus described different embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product.

What is claimed:

1. A device for releasing and mixing gas into molten metal, the device comprising:

(a) a motor;

(b) a drive shaft having a first end connected to the motor and a second end, the drive shaft having a passage through which gas can travel and opening at the second end through which the gas is released; and (c) an impeller connected to the second end of the drive shaft, the impeller comprising:

(i) a gas-release opening through which gas from the second end of the drive shaft is released;

(ii) a top portion having a lower surface;

(iii) a second portion below the lower surface of the top portion and connected to the lower surface, the second portion including a plurality of cavities and a protrusion between each cavity, wherein each protrusion has an edge for shearing gas as the impeller rotates, the edge of each protrusion being turned inwards towards the cavity to which it is juxtaposed, and the cavities, protrusions and edges are covered by the lower surface of the top portion;

wherein when gas is released from the gas-release opening it rises into the plurality of cavities and the lower surface of the top portion helps to retain the gas in the plurality of cavities to help mix the gas and molten metal, and the edges of the protrusions shear the gas into smaller bubbles to assist in mixing the gas with the molten metal.

2. The device of claim 1 wherein each cavity has the same configuration.

3. The device of claim 1 wherein the gas release opening is in the center of a bottom surface of the impeller.

4. The device of claim 1 wherein the first portion is square.

5. The device of claim 1 wherein the second portion has eight cavities.

6. The device of claim 4 wherein the second portion is circular.

7. The device of claim 5 wherein the second portion is circular and the cavities are equally radially spaced about the circumference of the second portion.

8. An impeller for use in a gas release device, the impeller comprising:

(a) a gas-release opening through which gas is released;

(b) a top portion having a lower surface;

(c) a second portion below the lower surface of the top portion, and connected to the lower surface the second portion including a plurality of cavities radially disposed thereabout and a protrusion between each cavity wherein each protrusion has an edge for shearing gas as the impeller rotates, the edge of each protrusion being turned inwards towards the cavity to which it is juxtaposed, and the cavities, protrusions and edges are covered by the lower surface of the top portion;

wherein when gas is released from the gas-release opening it rises into the plurality of cavities and the lower surface of the top portion helps to retain the gas in the plurality of cavities to help to mix the gas and molten metal, and the edges of the protrusions shear the gas into smaller bubbles to assist in mixing the gas with the molten metal.

9. The impeller of claim 8 wherein each cavity has the same configuration.

10. The impeller of claim 8 wherein the gas release opening is in the center of the bottom surface of the impeller.

11. The impeller of claim 8 wherein the first portion completely covers the second portion.

12. The impeller of claim 8 wherein the second portion has eight cavities.

13. The impeller of claim 8 wherein the second portion is circular and each of the plurality of cavities is equally radially spaced about the circumference of the second portion.

14. The impeller of claim 8 wherein the first portion is square.

15. The impeller of claim 8 wherein the first portion is substantially rectangular.

16. The impeller of claim 8 wherein the second portion is substantially circular.

17. The device of claim 1 wherein the drive shaft is comprised of:

(1) a motor shaft having a first end and second end; and (2) an impeller shaft having a first end and second end, the first end of the drive shaft being connected to the drive source and the second end of the motor shaft being coupled to the first end of the impeller shaft.

18. The device of claim 17 further comprising a coupling for connecting the drive shaft to the impeller shaft, the coupling having a first portion connected to the second end of the drive shaft and a second portion connected to the first end of the impeller shaft.

19. The impeller of claim 13 wherein the first portion is square.

* * * * *